US009349339B2

(12) United States Patent
Chuang et al.

(10) Patent No.: US 9,349,339 B2
(45) Date of Patent: May 24, 2016

(54) PRE-CHARGING APPARATUS OF SOURCE DRIVING CIRCUIT AND OPERATING METHOD THEREOF

(71) Applicant: Raydium Semiconductor Corporation, Hsinchu (TW)

(72) Inventors: Kai-Lan Chuang, Tainan (TW); Chien-Ru Chen, Pingtung County (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 123 days.

(21) Appl. No.: 14/468,471

(22) Filed: Aug. 26, 2014

(65) Prior Publication Data

US 2015/0062194 A1 Mar. 5, 2015

(30) Foreign Application Priority Data

Sep. 3, 2013 (TW) ..... 102131636 A

(51) Int. Cl.
*G09G 3/36* (2006.01)

(52) U.S. Cl.
CPC ..... *G09G 3/3688* (2013.01); *G09G 2310/0248* (2013.01)

(58) Field of Classification Search
CPC ..... G09G 3/3688; G09G 2310/0248; G09G 2330/021; G09G 2310/0291; G09G 2310/0251; G09G 2320/0204; G09G 2330/045; G09G 2340/16
See application file for complete search history.

(56) References Cited

U.S. PATENT DOCUMENTS

2008/0309601 A1* 12/2008 Furukoshi ..... G09G 3/3648 345/89
2012/0133631 A1* 5/2012 Lim ..... G09G 3/3688 345/211
2013/0169619 A1* 7/2013 Jeong ..... G09G 5/001 345/212

* cited by examiner

*Primary Examiner* — Ilana Spar
*Assistant Examiner* — Charles Zheng

(57) ABSTRACT

A source driver pre-charging apparatus including a data detection module, a determining module, and a pre-charging module is disclosed. The data detection module captures a first most significant bit having N bits in a current data and a second most significant bit having N bits in a former data and compares them to generate a compared result. N is a positive integer larger than or equal to 2. The determining module judges whether any data is transited from a first grey-level region to a second grey-level region between the former data and the current data and at least one other grey-level region is existed between the first grey-level region and the second grey-level region. If the judgment result of the determining module is yes, the pre-charging module performs a pre-charging action on an output voltage of a source driver.

12 Claims, 5 Drawing Sheets

PRE-CHARGING APPARATUS OF SOURCE DRIVING CIRCUIT AND OPERATING METHOD THEREOF

BACKGROUND OF THE INVENTION

1. Field of the Invention

This invention relates to a display, especially to a pre-charging apparatus and a pre-charging apparatus operating method applied in a source driver circuit of a display.

2. Description of the Related Art

With the increasing size of the LCD display panel, the load driven by the output operational amplifier (OP) disposed in the source driver circuit of the LCD display becomes heavier, and the output operational amplifier will encounter problems with power consumption and over-heating. Therefore, large-size LCD display panels may be required to reduce power consumption and prevent over-heating.

In order to reduce power consumption and prevent over-heating, a pre-charging function is used in some source driver circuits of the LCD display. Before the output operational amplifier in the source driver circuit starts to drive the output voltage of the source driver circuit, an external operational amplifier is used to perform the pre-charging function on the output voltage of the source driver circuit to make the output voltage level of the source driver circuit closes to a default output voltage, so that the voltage range necessary to be driven by the output operational amplifier of the source driver circuit is decreased to save power and prevent over-heating.

Using a 8-bit data signal as an example, the source driver circuit will capture the most significant bit (MSB) of a bit of a current data and the most significant bit of a bit of a former data and compare them. If the most significant bit is converted from 0 to 1 or from 1 to 0, the source driver circuit will start the pre-charging function to control an external pre-charging unit to increase the output voltage level of the source driver circuit to ¾ and ¼ of the default output voltage.

However, as shown in FIG. 1, 256 grey-levels L0~L255 can be divided into a red region RR including grey-levels L0~L127 and a blue region BR including grey-levels L128~L255. When the data signal is transited from the red region RR to the blue region BR or transited from the blue region BR to the red region RR, the source driver circuit will start the pre-charging function. When the large-size LCD panel displays an image having the grey-levels L0~L255, the grey-level inversion will occur near a junction of the red region RR and the blue region BR (e.g., the grey-levels L127~L129), and abnormal horizontal bright lines or dark lines will be shown in the image displayed on the large-size LCD panel; therefore, the image displaying quality of the large-size LCD panel will be poorer.

Because the most significant bit of the data signal is used to determine whether the pre-charging should be performed, as shown in FIG. 2, during the transition of the data signal DAT from the grey-level L127 to the grey-level L129, the voltage difference between the grey-levels L127 and L129 may be smaller than 5 mV, and when the data signal DAT is transited from the grey-level L127 to the grey-level L128 at first, the data signal DAT is transited from the red region RR to the blue region BR; therefore, the source driver circuit will start the pre-charging function. Then, when the data signal DAT is transited from the grey-level L128 to the grey-level L129, the output operational amplifier in the source driver circuit will drive the output voltage of the source driver circuit. Therefore, under the operation of high-frequency (240 Hz) frame rate, when the large-size LCD panel displays the grey-level L128 of the image, the output voltage is not totally driven by the output operational amplifier in the source driver circuit, the abnormal horizontal bright lines (higher than the grey-level L129) or dark lines (lower than the grey-level L128) would be easily shown in the image displayed on the large-size LCD panel. Although these abnormal horizontal bright lines or dark lines can be slightly improved by adjusting pre-charging voltage or lowering the frame rate to 120 Hz, it is not suitable for production because the voltage difference between the grey-levels L127 and L129 is too small to be well-adjusted.

Therefore, embodiments of the invention provide a pre-charging apparatus and a pre-charging apparatus operating method applied in a source driver circuit of a display to solve the above-mentioned problems.

SUMMARY OF THE INVENTION

An embodiment of the invention is a pre-charging apparatus. In this embodiment, the pre-charging apparatus is applied in a source driver of a display. The pre-charging apparatus includes a data detection module, a determining module, and a pre-charging module. The data detection module is used for capturing a first most significant bit having N bits in a current data and a second most significant bit having N bits in a former data and comparing the first most significant bit with the second most significant bit to generate a compared result, wherein N is a positive integer larger than or equal to 2. The determining module is used for determining whether there is any data transited from a first grey-level region to a second grey-level region between the former data and the current data and whether there is at least one other grey-level region existed between the first grey-level region and the second grey-level region according to the compared result to generate a pre-charging signal. The pre-charging module is used for performing a pre-charging action on an output voltage of a source driver if the determining result of the determining module is yes.

In an embodiment, if there is data transited from the first grey-level region to the second grey-level region between the former data and the current data, but the first grey-level region and the second grey-level region are adjacent, there is no other grey-level region existed between the first grey-level region and the second grey-level region, the determining result of the determining module is no, and the pre-charging module is not activated.

In an embodiment, if the first grey-level region is a red region and the second grey-level region is a blue region, and the red region and the blue region are adjacent, even there is data transited from the red region to the blue region between the former data and the current data, there is no other grey-level region existed between the red region and the blue region, the determining result of the determining module is no, and the pre-charging module is not activated.

In an embodiment, if the first grey-level region is a blue region and the second grey-level region is a red region, the blue region and the red region are adjacent, even there is data transited from the blue region to the red region between the former data and the current data, there is no other grey-level region existed between the blue region and the red region, the determining result of the determining module is no, and the pre-charging module is not activated.

In an embodiment, if there is no data transited from the first grey-level region to the second grey-level region between the former data and the current data, the determining result of the determining module is no, and the pre-charging module is not activated.

In an embodiment, the determining module is disposed in a timing controller of the display and the determining module transmits a plurality of pre-charging signals corresponding to a plurality of channels of the source driver to the source driver in a serial way.

Another embodiment of the invention is a pre-charging apparatus operating method. In this embodiment, the pre-charging apparatus operating method is used for operating a pre-charging apparatus applied in a source driver of a display. The pre-charging apparatus includes a data detection module, a determining module, and a pre-charging module. The pre-charging apparatus operating method includes steps of: (a) the data detection module capturing a first most significant bit having N bits in a current data and a second most significant bit having N bits in a former data and comparing the first most significant bit with the second most significant bit to generate a compared result, wherein N is a positive integer larger than or equal to 2; (b) the determining module determining whether there is any data transited from a first grey-level region to a second grey-level region between the former data and the current data and whether there is at least one other grey-level region existed between the first grey-level region and the second grey-level region according to the compared result to generate a pre-charging signal; and (c) if the determining result of the step (b) is yes, the pre-charging module performing a pre-charging action on an output voltage of a source driver.

Compared to the prior art, the pre-charging apparatus and the pre-charging apparatus operating method in the invention have many advantages of:

(1) when a large-size LCD panel displays a data signal, if the data signal is transited from a first grey-level region to a second grey-level region and the first grey-level region and the second grey-level region are adjacent, since there is no other grey-level region existed between the first grey-level region and the second grey-level region, the pre-charging module will not perform a pre-charging action on the output voltage of the source driver, no grey-level inversion will be occurred near a junction of different color grey-level regions (e.g., the grey-levels L127~L129), and no abnormal horizontal bright lines or dark lines will be shown on the large-size LCD panel to improve the image displaying quality of the LCD panel;

(2) if there is data transited from the first grey-level region to the second grey-level region and there is at least one other grey-level region existed between the first grey-level region and the second grey-level region, since the first grey-level region and the second grey-level region are not adjacent, no grey-level inversion will be occurred, the pre-charging module will perform the pre-charging action on the output voltage of the source driver to adjust the output voltage of the source driver more close to a default output voltage, so that the voltage range necessary to be driven by the output operational amplifier of the source driver will be deceased to save power and prevent over-heat;

(3) above all, the pre-charging apparatus and the pre-charging apparatus operating method in the invention can not only achieve effects of saving power and preventing over-heat by a pre-charging way, but also prevent the abnormal horizontal bright lines or dark lines shown in the image displayed on the LCD panel to improve the image displaying quality of the LCD panel.

The advantage and spirit of the invention may be understood by the following detailed descriptions together with the appended drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
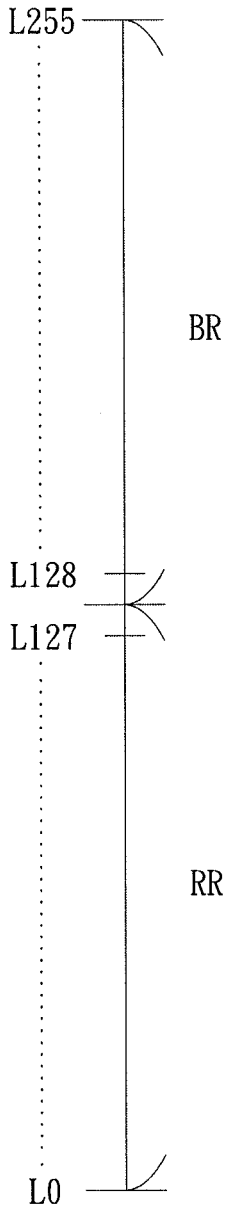
FIG. 1 (PRIOR ART)
FIG. 1 illustrates the 256 grey-levels L0~L255 divided into a red region including grey-levels L0~L127 and a blue region including grey-levels L128~L255.
Figure 2:
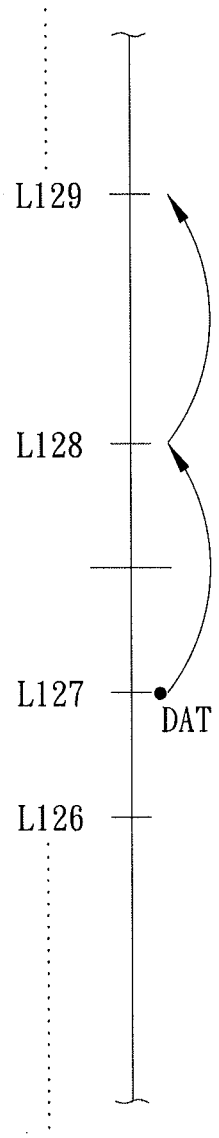
FIG. 2 (PRIOR ART)
FIG. 2 illustrates the transitions of the data signal DAT from the grey-level L127 to the grey-level L128 and then from the grey-level L128 to the grey-level L129.
Figure 3:
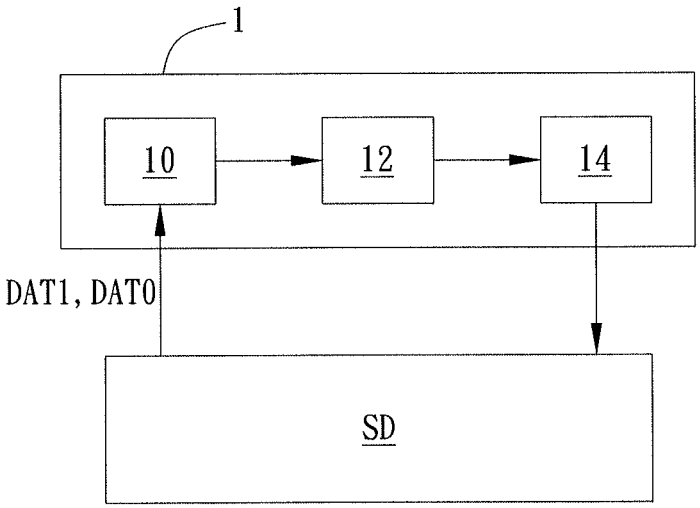
FIG. 3 illustrates a functional block diagram of the pre-charging apparatus applied in the source driver circuit in an embodiment of the invention.

A preferred embodiment of the invention is a pre-charging apparatus. In this embodiment, the pre-charging apparatus is applied in a source driver circuit of a display, but not limited to this. At first, please refer to FIG. 3. FIG. 3 illustrates a functional block diagram of the pre-charging apparatus applied in the source driver circuit in this embodiment.

As shown in FIG. 3, the pre-charging apparatus 1 is coupled to the source driver circuit SD. The pre-charging apparatus 1 includes a data detection module 10, a determining module 12, and a pre-charging module 14. Wherein, the data detection module 10 is coupled to the source driver circuit SD; the determining module 12 is coupled to the data detection module 10; the pre-charging module 14 is coupled to the determining module 12 and the source driver circuit SD.

In this embodiment, the data detection module 10 detects a current data DAT1 and a former data DAT0 from the source driver circuit SD respectively and captures a first most significant bit having N bits in the current data DAT1 and a second most significant bit having N bits in the former data DAT0 respectively, and then the data detection module 10 compares the first most significant bit with the second most significant bit to generate a compared result, wherein N is a positive integer larger than or equal to 2.

If the current data DAT1 and the former data DAT0 both have 8 bits, and N equals to 2, the first most significant bit having 2 bits in the current data DAT1 can be 00, 01, 10, or 11 and the second most significant bit having 2 bits in the former data DAT0 can be 00, 01, 10, or 11.

Figure 4:
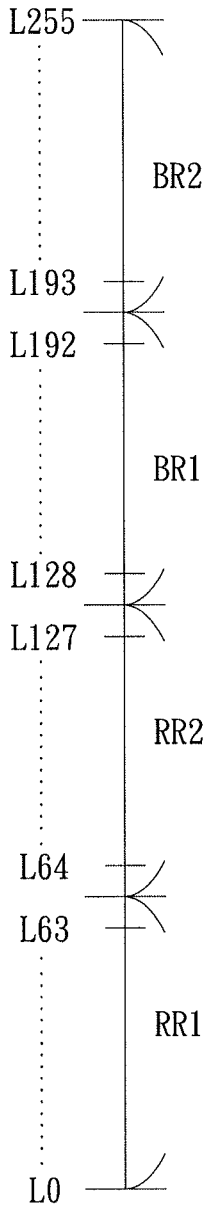
FIG. 4 illustrates the 256 grey-levels L0~L255 divided into a first red region including grey-levels L0~L63, a second red region including grey-levels L64~L127, a first blue region including grey-levels L128~L192, and a second blue region including grey-levels L193~L255.

As shown in FIG. 4, the 256 grey-levels L0~L255 can be divided into a first red region RR1 including the grey-levels L0~L63 corresponding to the most significant bit 00, a second red region RR2 including the grey-levels L64~L127 corresponding to the most significant bit 01, a first blue region BR1 including the grey-levels L128~L192 corresponding to the most significant bit 10, and a second blue region BR2 including the grey-levels L193~L255 corresponding to the most significant bit 11.

If the compared result of the data detection module 10 is that the first most significant bit in the current data DAT1 is the same with the second most significant bit in the former data DAT0, the first most significant bit and the second most significant bit are both 00, 01, 10, or 11. It means that there is no data transited from one grey-level region to another grey-level region between the former data DAT0 and the current data DAT1, the data is maintained in the same grey-level region. Therefore, when the determining module 12 determines whether any data transited from the first grey-level region to the second grey-level region between the former data DAT0 and the current data DAT1 and whether there is at least one other grey-level region existed between the first grey-level region and the second grey-level region according to this compared result, the determined result of the determining module 12 will be no, and the pre-charging module 14 will not be activated.

On the other hand, the compared result of the data detection module 10 can be that the first most significant bit in the current data DAT1 is different from the second most significant bit in the former data DAT0, for example, the first most significant bit is 00 and the second most significant bit is 11, or the first most significant bit is 01 and the second most significant bit is 10, but not limited to this.

Taking the compared result that the first most significant bit is 00 and the second most significant bit is 11 for example, since the first most significant bit in the current data DAT1 is different from the second most significant bit in the former data DAT0, it means that there is some data transited from the first red region RR1 corresponding to the first most significant bit 00 to the second blue region BR2 corresponding to the second most significant bit 11 between the former data DAT0 and the current data DAT1, and there are still the second red region RR2 corresponding to the most significant bit 01 and the first blue region BR1 corresponding to the most significant bit 10 between the first red region RR1 and the second blue region BR2, and no grey-level inversion will be occurred.

Therefore, when the determining module 12 determines whether any data transited from the first grey-level region to the second grey-level region between the former data DAT0 and the current data DAT1 and whether there is at least one other grey-level region existed between the first grey-level region and the second grey-level region according to this compared result, the determined result of the determining module 12 will be yes, and the pre-charging module 14 will be activated to perform pre-charging on the output voltage of the source driver circuit SD.

Taking the compared result that the first most significant bit is 01 and the second most significant bit is 10 for example, the first most significant bit in the current data DAT1 is different from the second most significant bit in the former data DAT0, it means that there is some data transited from the second red region RR2 corresponding to the first most significant bit 01 to the first blue region BR1 corresponding to the second most significant bit 10 between the former data DAT0 and the current data DAT1; however, the second red region RR2 corresponding to the first most significant bit 01 is adjacent to the first blue region BR1 corresponding to the second most significant bit 10, that is to say, there is no other grey-level region between the second red region RR2 and the first blue region BR1, and grey-level inversion may be occurred.

Therefore, when the determining module 12 determines whether any data transited from the first grey-level region to the second grey-level region between the former data DAT0 and the current data DAT1 and whether there is at least one other grey-level region existed between the first grey-level region and the second grey-level region according to this compared result, the determined result of the determining module 12 will be no, and the pre-charging module 14 will not be activated. By doing so, no grey-level inversion will be occurred near a junction of different color grey-level regions (e.g., the grey-levels L127~L129), and no abnormal horizontal bright lines or dark lines will be shown on the large-size LCD panel to improve the image displaying quality of the LCD panel.

From above, it can be found that as shown in FIG. 4, the determined result of the determining module 12 will be yes only when the data signal is transited from the first red region RR1 to the first blue region BR1 or the second blue region BR2, transited from the second red region RR2 to the second blue region BR2, transited from the first blue region BR1 to the first red region RR1, or transited from the second blue region BR2 to the first red region RR1 or the second red region RR2, and the pre-charging module 14 will be activated to perform pre-charging on the output voltage of the source driver circuit SD. In other conditions, the determined result of the determining module 12 will be no, and the pre-charging module 14 will not be activated.

Figure 5:
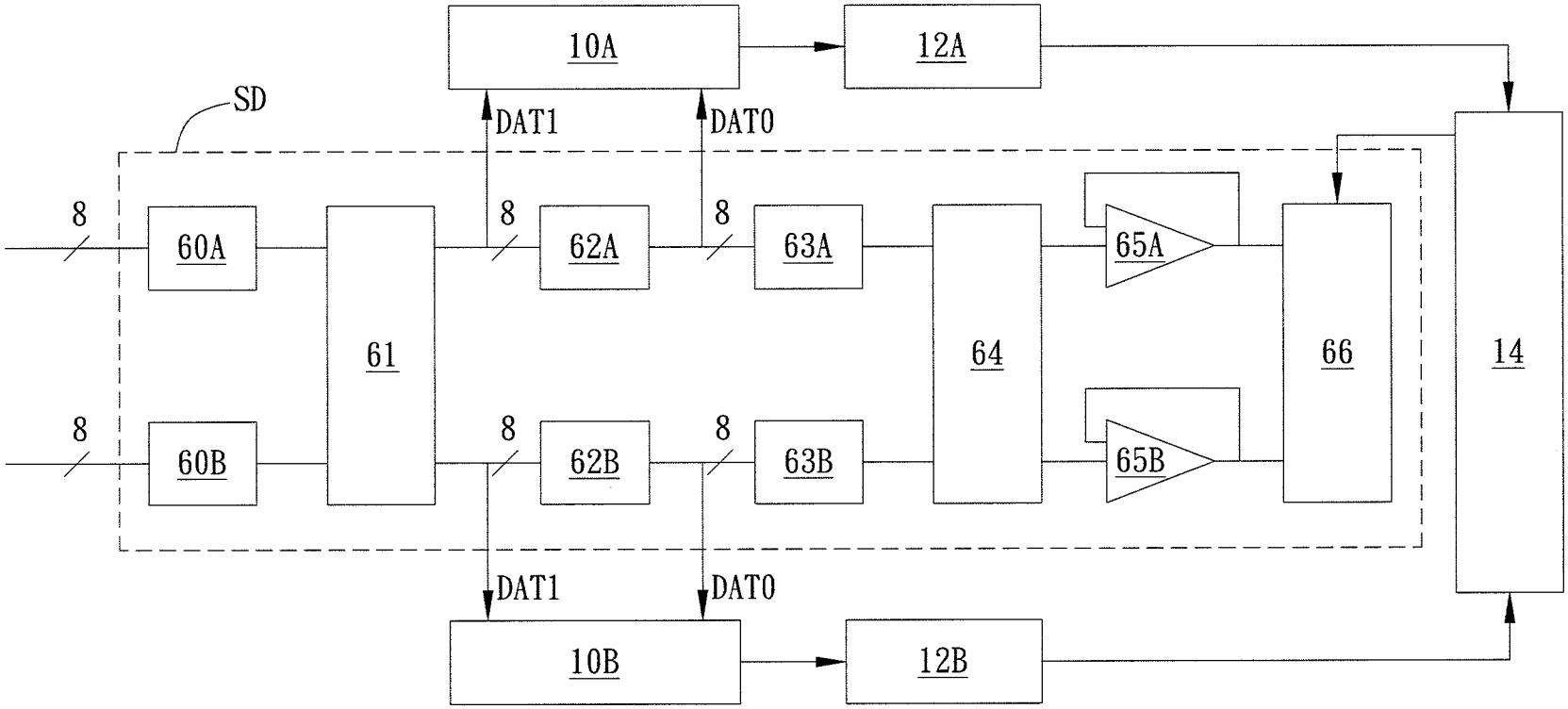
FIG. 5 illustrates a functional block diagram of the pre-charging apparatus applied in the source driver circuit having two channels in another embodiment of the invention.

Please refer to FIG. 5. FIG. 5 illustrates a functional block diagram of the pre-charging apparatus applied in the source driver circuit having two channels in another embodiment. As shown in FIG. 5, the source driver circuit SD includes first data latches 60A and 60B, a multiplexer 61, second data latches 62A and 62B, level shifters 63A and 63B, an input multiplexer 64, a P-type output operational amplifier 65A, a N-type output operational amplifier 65B, and an output multiplexer 66. Wherein, the first data latches 60A and 60B are coupled to input terminals of the multiplexer 61; output terminals of the multiplexer 61 are coupled to the second data latches 62A and 62B; the second data latches 62A and 62B are coupled to the level shifters 63A and 63B; the level shifters 63A and 63B are coupled to input terminals of the input multiplexer 64; output terminals of the input multiplexer 64 are coupled to input terminals of the P-type output operational amplifier 65A and the N-type output operational amplifier 65B; output terminals of the P-type output operational amplifier 65A and the N-type output operational amplifier 65B are coupled to input terminals of the output multiplexer 66.

In this embodiment, the pre-charging apparatus 1 includes data detection modules 10A and 10B, determining modules 12A and 12B, and a pre-charging module 14. The data detection module 10A is coupled to a node between the output terminal of the multiplexer 61 and the second data latch 62A and a node between the second data latch 62A and the level shifter 63A respectively, and the data detection module 10A is used to detect the former data DAT0 and the current data DAT1 in the first channel from the node between the output terminal of the multiplexer 61 and the second data latch 62A and the node between the second data latch 62A and the level shifter 63A respectively. The data detection module 10A is also coupled to the determining module 12A; the determining module 12A is coupled to the pre-charging module 14; the pre-charging module 14 is coupled to the output multiplexer 66 of the source driver circuit SD.

Similarly, the data detection module 10B is coupled to a node between the output terminal of the multiplexer 61 and the second data latch 62B and a node between the second data latch 62B and the level shifter 63B respectively, and the data detection module 10B is used to detect the former data DAT0 and the current data DAT1 in the second channel from the node between the output terminal of the multiplexer 61 and the second data latch 62B and the node between the second data latch 62B and the level shifter 63B respectively. The data detection module 10B is also coupled to the determining module 12B; the determining module 12B is coupled to the pre-charging module 14.

After the data detection module 10A detects the former data DAT0 and the current data DAT1 in the first channel from the node between the output terminal of the multiplexer 61 and the second data latch 62A and the node between the second data latch 62A and the level shifter 63A respectively, the data detection module 10A will capture a first most significant bit having N bits in the current data DAT1 and a second most significant bit having N bits in the former data DAT0 respectively, and then the data detection module 10A will compare the first most significant bit with the second most significant bit to generate a compared result, wherein N is a positive integer larger than or equal to 2. Then, the determining module 12A will determine whether any data transited from the first grey-level region to the second grey-level region between the former data DAT0 and the current data DAT1 and whether there is at least one other grey-level region existed between the first grey-level region and the second grey-level region according to this compared result of the data detection module 10A.

If the determined result of the determining module 12A is yes, the pre-charging module 14 will be activated to perform pre-charging on the output voltage of the output multiplexer 66 of the source driver circuit SD, so that when the P-type output operational amplifier 65A and the N-type output operational amplifier 65B of the source driver circuit SD start to drive the output voltage, the voltage range needed to be driven will become smaller to reduce power consumption and prevent over-heat. If the determined result of the determining module 12A is no, the pre-charging module 14 will not be activated to avoid the grey-level inversion occurred near the junction of different color grey-level regions (e.g., the grey-levels L127~L129); therefore, the image displaying quality of the LCD panel can be effectively improved.

Similarly, after the data detection module 10B detects the current data DAT1 and the former data DAT0 in the second channel from the node between the output terminal of the multiplexer 61 and the second data latch 62B and the node between the second data latch 62B and the level shifter 63B respectively, the data detection module 10B will capture the first most significant bit having N bits in the current data DAT1 and the second most significant bit having N bits in the former data DAT0 respectively, and then the data detection module 10B will compare the first most significant bit with the second most significant bit to generate a compared result, wherein N is a positive integer larger than or equal to 2. Then, the determining module 12B will determine whether any data transited from the first grey-level region to the second grey-level region between the former data DAT0 and the current data DAT1 and whether there is at least one other grey-level region existed between the first grey-level region and the second grey-level region according to this compared result of the data detection module 10B. If the determined result of the determining module 12B is yes, the pre-charging module 14 will be activated to perform pre-charging on the output voltage of the output multiplexer 66 of the source driver circuit SD to reduce power consumption and avoid over-heat. If the determined result of the determining module 12A is no, the pre-charging module 14 will not be activated to avoid the grey-level inversion occurred near the junction of different color grey-level regions.

In practical applications, the determining module in the pre-charging apparatus of the invention can be also disposed in the data detection module or disposed in a timing controller (T-CON) of the display, and the determining module will transmit a plurality of pre-charging signals corresponding to the plurality of channels of the source driver circuit to the source driver circuit in a serial way only through one pin, and then the source driver circuit will capture the plurality of pre-charging signals to their corresponding channels respectively according to the shift register signals in the source driver circuit.

Figure 6:
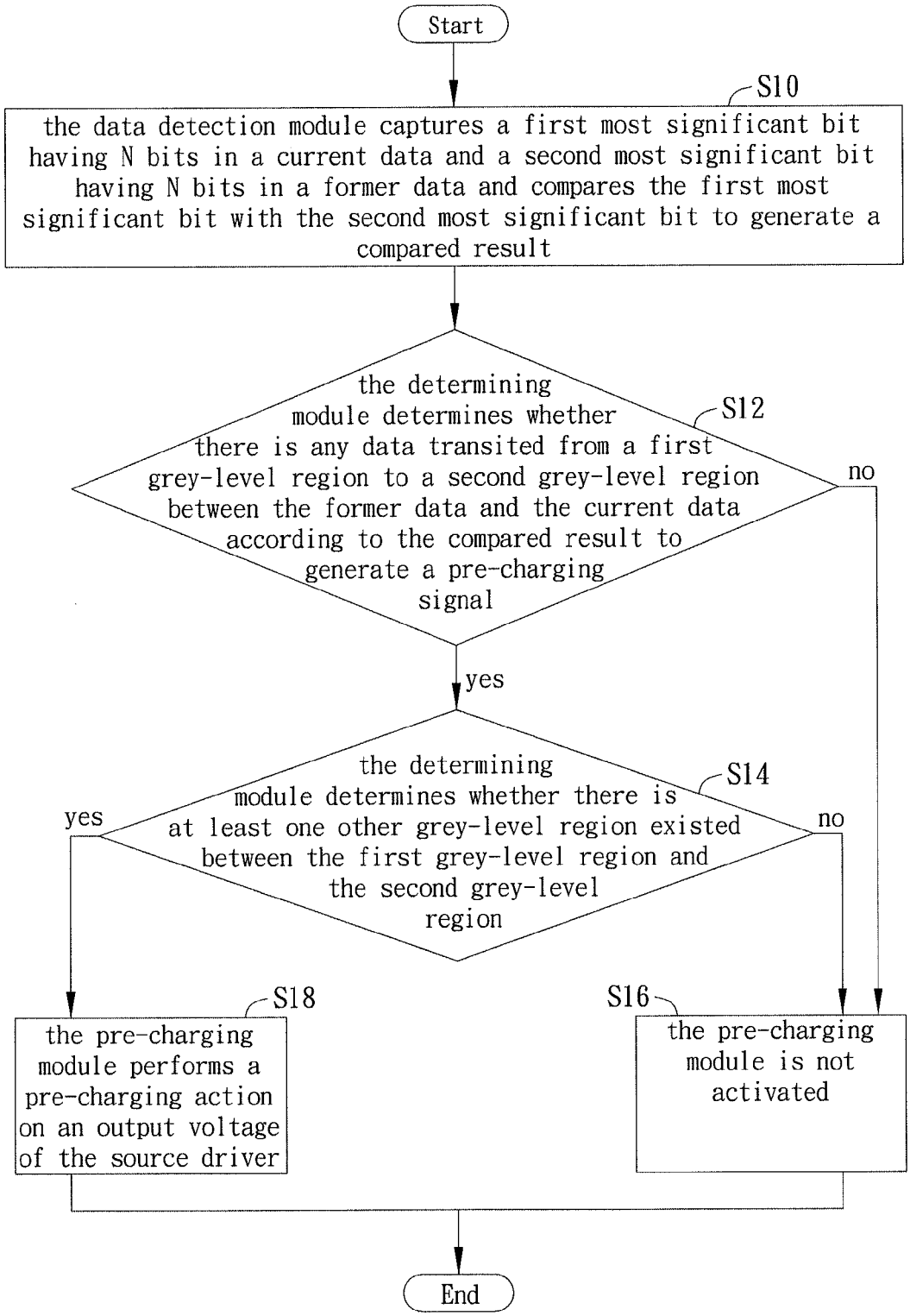
FIG. 6 illustrates a flowchart of the pre-charging apparatus operating method in another embodiment of the invention.

Another embodiment of the invention is a pre-charging apparatus operating method. In this embodiment, the pre-charging apparatus operating method is used for operating a pre-charging apparatus applied in a source driver of a display. The pre-charging apparatus includes a data detection module, a determining module, and a pre-charging module. Please refer to FIG. 6. FIG. 6 illustrates a flowchart of the pre-charging apparatus operating method in this embodiment.

As shown in FIG. 6, at first, in the step S10, the data detection module captures a first most significant bit having N bits in a current data and a second most significant bit having N bits in a former data and compares the first most significant bit with the second most significant bit to generate a compared result, wherein N is a positive integer larger than or equal to 2.

Then, in the step S12, the determining module determines whether there is any data transited from a first grey-level region to a second grey-level region between the former data and the current data according to the compared result to generate a pre-charging signal.

If the determining result of the step S12 is yes, the method performs the step S14. In the step S14, the determining module determines whether there is at least one other grey-level region existed between the first grey-level region and the second grey-level region. If the determining result of the step S12 is no, the method performs the step S16. In the step S16, the pre-charging module is not activated.

If the determining result of the step S14 is yes, the method performs the step S18. In the step S18, the pre-charging module performs a pre-charging action on an output voltage of the source driver. If the determining result of the step S14 is no, the method performs the step S16. In the step S16, the pre-charging module will not be activated.

Compared to the prior art, the pre-charging apparatus and the pre-charging apparatus operating method in the invention have many advantages of:

(1) when a large-size LCD panel displays a data signal, if the data signal is transited from a first grey-level region to a second grey-level region and the first grey-level region and the second grey-level region are adjacent, since there is no other grey-level region existed between the first grey-level region and the second grey-level region, the pre-charging module will not perform a pre-charging action on the output voltage of the source driver, no grey-level inversion will be occurred near a junction of different color grey-level regions (e.g., the grey-levels L127~L129), and no abnormal horizontal bright lines or dark lines will be shown on the large-size LCD panel to improve the image displaying quality of the LCD panel;

(2) if there is data transited from the first grey-level region to the second grey-level region and there is at least one other grey-level region existed between the first grey-level region and the second grey-level region, since the first grey-level region and the second grey-level region are not adjacent, no grey-level inversion will be occurred, the pre-charging module will perform the pre-charging action on the output voltage of the source driver to adjust the output voltage of the source driver more close to a default output voltage, so that the voltage range necessary to be driven by the output operational amplifier of the source driver will be deceased to save power and prevent over-heat;

(3) above all, the pre-charging apparatus and the pre-charging apparatus operating method in the invention can not only achieve effects of saving power and preventing over-heat by a pre-charging way, but also prevent the abnormal horizontal bright lines or dark lines shown in the image displayed on the LCD panel to improve the image displaying quality of the LCD panel.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

The invention claimed is:

1. A pre-charging apparatus, applied in a source driver of a display, the pre-charging apparatus comprising:

a data detection module for capturing a first most significant bit having N bits in a current data and a second most significant bit having N bits in a former data and comparing the first most significant bit with the second most significant bit to generate a compared result, wherein N is a positive integer larger than or equal to 2, but less than a wordlength representing a number of bits used to represent each one of the current data and the former data;

a determining module for determining whether there is any data transited from a first grey-level region to a second grey-level region between the former data and the current data and whether there is at least one other grey-level region existed between the first grey-level region and the second grey-level region according to the compared result to generate a pre-charging signal, wherein each respective grey-level region is defined by the most significant bits having N bits; and a pre-charging module for performing a pre-charging action on an output voltage of a source driver if the determining result of the determining module is yes.

2. The pre-charging apparatus of claim 1, wherein if there is data transited from the first grey-level region to the second grey-level region between the former data and the current data, but the first grey-level region and the second grey-level region are adjacent, there is no other grey-level region existed between the first grey-level region and the second grey-level region, the determining result of the determining module is no, and the pre-charging module is not activated.

3. The pre-charging apparatus of claim 2, wherein if the first grey-level region is a red region and the second grey-level region is a blue region, and the red region and the blue region are adjacent, even there is data transited from the red region to the blue region between the former data and the current data, there is no other grey-level region existed between the red region and the blue region, the determining result of the determining module is no, and the pre-charging module is not activated.

4. The pre-charging apparatus of claim 2, wherein if the first grey-level region is a blue region and the second grey-level region is a red region, the blue region and the red region are adjacent, even there is data transited from the blue region to the red region between the former data and the current data, there is no other grey-level region existed between the blue region and the red region, the determining result of the determining module is no, and the pre-charging module is not activated.

5. The pre-charging apparatus of claim 1, wherein if there is no data transited from the first grey-level region to the second grey-level region between the former data and the current data, the determining result of the determining module is no, and the pre-charging module is not activated.

6. The pre-charging apparatus of claim 1, wherein the determining module is disposed in a timing controller of the display and the determining module transmits a plurality of pre-charging signals corresponding to a plurality of channels of the source driver to the source driver in a serial way.

7. A pre-charging apparatus operating method for operating a pre-charging apparatus applied to a source driver of a display, the pre-charging apparatus comprising a data detection module, a determining module, and a pre-charging module, the pre-charging apparatus operating method comprising steps of:

(a) the data detection module capturing a first most significant bit having N bits in a current data and a second most significant bit having N bits in a former data and comparing the first most significant bit with the second most significant bit to generate a compared result, wherein N is a positive integer larger than or equal to 2, but less than a wordlength representing a number of bits used to represent each one of the current data and the former data;

(b) the determining module determining whether there is any data transited from a first grey-level region to a second grey-level region between the former data and the current data and whether there is at least one other grey-level region existed between the first grey-level region and the second grey-level region according to the compared result to generate a pre-charging signal, wherein each respective grey-level region is defined by the most significant bit having N bits; and (c) if the determining result of the step (b) is yes, the pre-charging module performing a pre-charging action on an output voltage of a source driver.

8. The pre-charging apparatus operating method of claim 7, wherein if there is data transited from the first grey-level region to the second grey-level region between the former data and the current data, but the first grey-level region and the second grey-level region are adjacent, there is no other grey-level region existed between the first grey-level region and the second grey-level region, the determining result of the step (b) is no, and the pre-charging module is not activated.

9. The pre-charging apparatus operating method of claim 8, wherein if the first grey-level region is a red region and the second grey-level region is a blue region, and the red region and the blue region are adjacent, even there is data transited from the red region to the blue region between the former data and the current data, there is no other grey-level region existed between the red region and the blue region, the determining result of the step (b) is no, and the pre-charging module is not activated.

10. The pre-charging apparatus operating method of claim 8, wherein if the first grey-level region is a blue region and the second grey-level is a red region, and the blue region and the red region are adjacent, even there is data transited from the blue region to the red region between the former data and the current data, there is no other grey-level region existed between the blue region and the red region, the determining result of the step (b) is no, and the pre-charging module is not activated.

11. The pre-charging apparatus operating method of claim 7, wherein if there is no data transited from the first grey-level region to the second grey-level region between the former data and the current data, the determining result of the step (b) is no, and the pre-charging module is not activated.

12. The pre-charging apparatus operating method of claim 7, wherein the determining module is disposed in a timing controller of the display and the determining module transmits a plurality of pre-charging signals corresponding to a plurality of channels of the source driver to the source driver in a serial way.

* * * * *